US005461192A

United States Patent [19]

Imaizumi

[11] Patent Number: 5,461,192

[45] Date of Patent: Oct. 24, 1995

[54] ELECTRONIC MUSICAL INSTRUMENT USING A PLURALITY OF REGISTRATION DATA

[75] Inventor: Tsutomu Imaizumi, Hamamatsu, Japan

[73] Assignee: Yamaha Corporation, Hamamatsu, Japan

[21] Appl. No.: 48,480

[22] Filed: Apr. 16, 1993

[30] Foreign Application Priority Data

Apr. 20, 1992 [JP] Japan ..... 4-126863

[51] Int. Cl.[6] ..... G10H 7/00; G10H 1/40

[52] U.S. Cl. ..... 84/634; 84/610

[58] Field of Search ..... 84/634, 666, 609–611, 84/635, 649–651, 667

[56] References Cited

U.S. PATENT DOCUMENTS

| | | | |
|---|---|---|---|
| 4,748,885 | 6/1988 | Sato | 84/634 |
| 4,930,390 | 6/1990 | Kellogg et al. | 84/611 |
| 5,208,416 | 5/1993 | Hayakawa et al. | 84/634 |
| 5,270,477 | 12/1993 | Kawashima | 84/622 |
| 5,288,941 | 2/1994 | Sekizaka | 84/615 |
| 5,290,967 | 3/1994 | Shimaya | 84/633 |

FOREIGN PATENT DOCUMENTS

| | | |
|---|---|---|
| 62-187397 | 8/1987 | Japan . |
| 62-187398 | 8/1987 | Japan . |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical instrument with an automatic accompaniment function has a plurality of registration data corresponding to an accompaniment patterns, and a registration can be selected from the plurality of registration data corresponding to the selected and designated accompaniment pattern. The registration data represents a set of data such as the tone color, tone volume, effect, and the like of musical tones, for defining a performance environment. A plurality of accompaniment patterns are prepared for each style. When an accompaniment pattern is changed, the registration is changed in correspondence with the changed accompaniment pattern. Furthermore, when an accompaniment pattern is changed between different pattern groups, the registration is changed. When an accompaniment pattern is changed in one pattern group, the registration is left unchanged. The pattern group is a group of a plurality of similar accompaniment patterns.

14 Claims, 7 Drawing Sheets

ELECTRONIC MUSICAL INSTRUMENT USING A PLURALITY OF REGISTRATION DATA

BACKGROUND OF THE INVENTION

1. Field of the Invention

The present invention relates to an electronic musical instrument having an automatic accompaniment function and, more specifically, to an electronic musical instrument, which can realize various performances having high musicality and free from unnaturalness by an easy operation.

2. Description of the Related Art

A conventional electronic musical instrument with an automatic accompaniment function pre-stores performance data (accompaniment pattern data) of a plurality of accompaniment patterns (e.g., rock & roll, pops, and the like), and selectively uses the accompaniment patterns for music to be played (e.g., Japanese Patent Laid-Open No. 62-187398).

Another electronic musical instrument comprises a memory called a registration memory, and switches called registration switches, and can simultaneously set a plurality of setting data such as a tone color, tone volume, effect, and the like of a musical tone (Japanese Patent Laid-Open No. 62-187397). Generally, an electronic musical instrument is provided with a large number of panel switches for individually selecting ON/OFF states or setting stepwise a tone color, tone volume, effect, and the like of a musical tone, and a user realizes a desired performance environment by setting these data. The registration memory stores a plurality of registrations. One registration is a set of parameters, and each set includes a plurality of setting data such as the tone color, tone volume, effect, and the like of a musical tone. Each registration can be read out by turning on, e.g., one registration switch.

According to this electronic musical instrument, the setting states of a large number of switches can be simultaneously switched by operating one registration switch in place of operations of a plurality of panel switches, thereby setting a performance environment. Therefore, operability upon switching of the performance environment during a performance can be improved. Since the registration data includes contents associated with an arrangement such as a combination of optimal instruments, a balance among performance parts, and the like for music to be played, it is preferable to set the registration data by a person who has expert knowledge about music. For this reason, the registration data is generally stored as factory preset data.

When the above-mentioned registration technique is simply combined with the electronic musical instrument with the automatic accompaniment function, a performance environment of the electronic musical instrument with the automatic accompaniment function can be easily switched upon operation of the registration switch. However, since an automatic accompaniment pattern has no relation to a registration, improper registration may be selected for an automatic accompaniment pattern. In this case, if the selected pattern and registration are not harmonized with each other, an actually produced tone becomes musically unnatural.

SUMMARY OF THE INVENTION

It is an object of the present invention to provide an electronic musical instrument, which can realize various performances having high musicality and free from unnaturalness by an easy operation.

According to the first aspect of the present invention, there is provided an electronic musical instrument comprising pattern storage means for storing a plurality of accompaniment pattern data, registration storage means for storing a plurality of registration data in units of accompaniment pattern data, pattern designation means for selecting and designating arbitrary accompaniment pattern data from the plurality of accompaniment pattern data, registration designation means for selecting and designating arbitrary registration data from the plurality of registration data corresponding to the accompaniment pattern data selected and designated by the pattern designation means, automatic accompaniment means for performing an automatic accompaniment on the basis of the accompaniment pattern data selected and designated by the pattern designation means, and performance environment setting means for setting a performance environment on the basis of the registration data selected and designated by the registration designation means.

According to the second aspect of the present invention, there is provided an electronic musical instrument comprising pattern storage means for storing a plurality of accompaniment patterns in units of a plurality of accompaniment styles, registration storage means for storing a plurality of registration data in units of accompaniment styles, style designation means for selecting and designating an arbitrary accompaniment style from the plurality of accompaniment styles, pattern designation means for selecting and designating arbitrary accompaniment pattern data from the plurality of accompaniment pattern data corresponding to the accompaniment style selected and designated by the style designation means, registration designation means for selecting and designating arbitrary registration data from the plurality of registration data corresponding to the accompaniment style selected and designated by the style designation means, automatic accompaniment means for performing an automatic accompaniment on the basis of the accompaniment pattern data selected and designated by the pattern designation means, performance environment setting means for setting a performance environment on the basis of the registration data selected and designated by the registration designation means, and registration change control means for, when the accompaniment pattern data is changed in the same accompaniment style by the pattern designation means, changing the registration data between the registrations according to the accompaniment style in correspondence with the changed accompaniment pattern data.

According to the third aspect of the present invention, there is provided an electronic musical instrument comprising pattern storage means for storing a plurality of accompaniment patterns, which are grouped into a first pattern group consisting of a plurality of basic accompaniment pattern, and a second pattern group consisting of a plurality of variation patterns, in units of a plurality of accompaniment styles, registration storage means for storing a plurality of registration data in units of accompaniment styles, style designation means for selecting and designating an arbitrary accompaniment style from the plurality of accompaniment styles, pattern designation means for selecting and designating arbitrary accompaniment pattern data from the plurality of accompaniment pattern data corresponding to the accompaniment style selected and designated by the style designation means, registration designation means for selecting and designating arbitrary registration data from the plurality of registration data corresponding to the accompaniment style selected and designated by the style designation means, automatic accompaniment means for performing an automatic accompaniment on the basis of the accompaniment pattern data selected and designated by the pattern designation means, performance environment setting means for setting a performance environment on the basis of the registration data selected and designated by the registration designation means, and registration change control means for, when the accompaniment pattern data is changed between different pattern groups by the pattern designation means, controlling to change the registration data in correspondence with the changed accompaniment pattern data, and for, when the accompaniment pattern data is changed within the pattern group, controlling not to change the registration data.

In the electronic musical instrument according to the first aspect of the present invention, a plurality of registration data are prepared in units of accompaniment patterns. When one accompaniment pattern is selected and designated, a registration can be selected from the plurality of registration data corresponding to the selected accompaniment pattern. Therefore, as long as a plurality of registrations suitable for each accompaniment pattern are prepared in units of accompaniment patterns, when a user selects any registration therefrom, the accompaniment pattern and the registration can always be harmonized with each other.

In the electronic musical instrument according to the second aspect of the present invention, a plurality of accompaniment patterns prepared in advance are grouped in units of accompaniment styles. The accompaniment style means a concept such as a genre of music. Similarly, a plurality of registration data are prepared in units of accompaniment styles. When a user selects and designates an accompaniment style, he or she can select a desired accompaniment pattern from the plurality of accompaniment patterns corresponding to the selected accompaniment style, and can similarly select desired registration data from the plurality of registration data corresponding to the selected accompaniment style. When an accompaniment pattern is changed, in particular, when an accompaniment pattern is changed to another in the same accompaniment style, a registration is also switched to another one in registration data according to the accompaniment style in correspondence with the changed accompaniment pattern.

In the electronic musical instrument according to the third aspect of the present invention, a plurality of accompaniment patterns prepared in advance are grouped in units of accompaniment styles. Furthermore, the plurality of accompaniment patterns corresponding to each accompaniment style are grouped into a first pattern group consisting of a plurality of basic accompaniment patterns, and a second pattern group consisting of a plurality of variation patterns. A plurality of registration data are prepared in units of accompaniment styles. When an accompaniment pattern is changed to another in another pattern group, registration data is also changed in correspondence with the changed accompaniment pattern. However, when an accompaniment pattern is changed to another in the same pattern group, registration data is left unchanged.

DETAILED DESCRIPTION OF THE PREFERRED EMBODIMENT

The preferred embodiment of the present invention will be described hereinafter with reference to the accompanying drawings.

Figure 1:
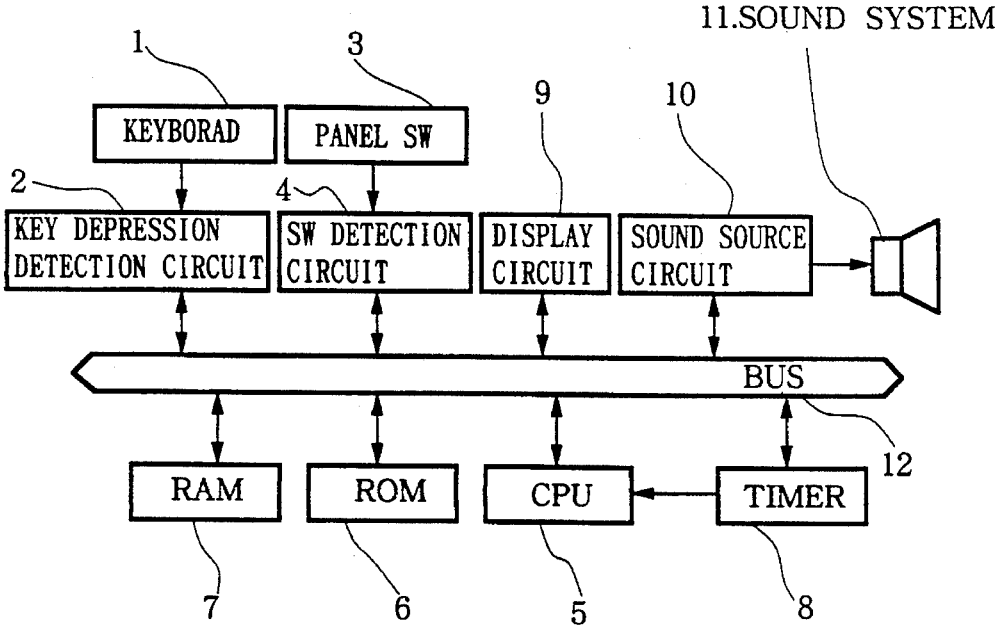
FIG. 1 is a block diagram showing an arrangement of an electronic musical instrument according to an embodiment of the present invention.

FIG. 1 is a block diagram showing an arrangement of an electronic musical instrument according to an embodiment of the present invention. The electronic musical instrument comprises a keyboard 1, a key depression detection circuit 2, a panel switch (SW) unit 3, a switch detection circuit 4, a central processing unit (CPU) 5, a read-only memory (ROM) 6, a random-access memory (RAM) 7, a timer 8, a display circuit 9, a sound source circuit 10, a sound system 11, and a bus line 12.

The keyboard 1 has a plurality of keys to be played by a player. When a player operates the keyboard 1, the key depression detection circuit 2 detects the operation, and supplies play information (e.g., a key-ON or key-OFF signal, touch information, and the like) to the CPU 5 via the bus line 12. The panel switch unit 3 includes a plurality of switches, arranged on a panel, for setting various data such as the tone color, tone volume, effect, and the like of a musical tone. The switch detection circuit 4 detects operations of the switches of the panel switch unit 3, and supplies operation information to the CPU 5 via the bus line 12.

The display circuit 9 displays various kinds of information on a display unit on the panel on the basis of an instruction from the CPU 5. The CPU 5 controls the operation of the overall electronic musical instrument as well as selection of an accompaniment pattern and selection of a registration (to be described later). The ROM 6 stores a program executed by the CPU 5, and various table data. The RAM 7 is assigned with various work areas. The timer 8 generates an interrupt signal at a predetermined time interval.

The sound source circuit 10 generates a musical tone signal on the basis of an instruction from the CPU 5, and supplies the signal to the sound system 11. The sound system 11 produces an actual tone according to the input musical tone signal.

Figure 2:
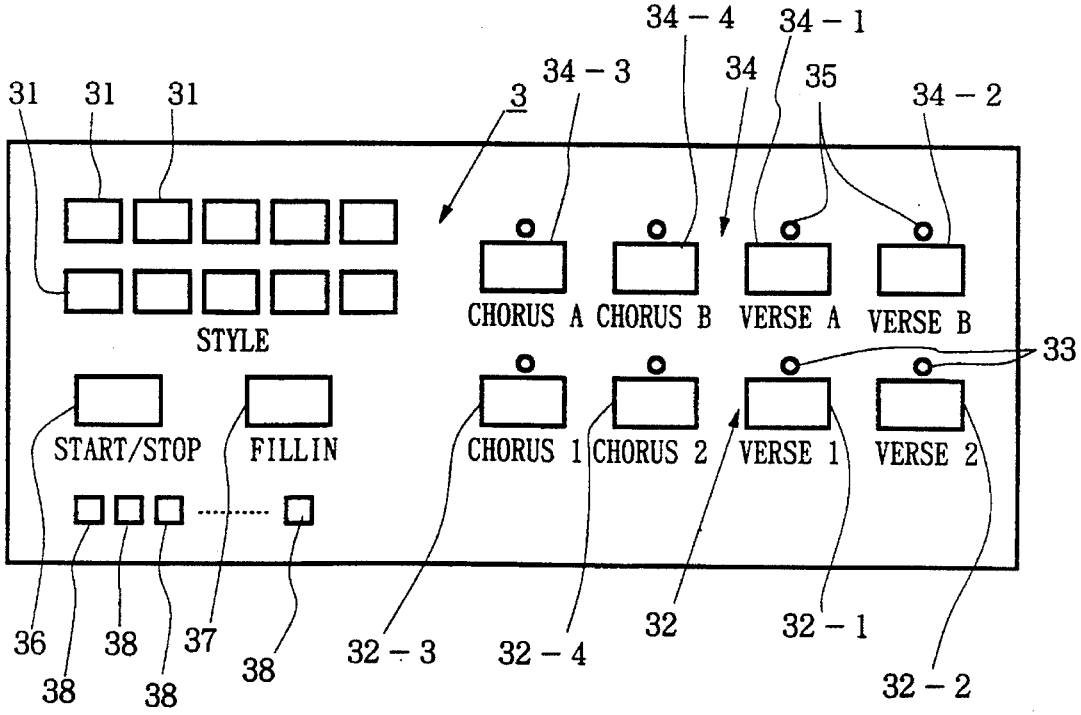
FIG. 2 is a plan view showing the outer appearance of panel switches of the electronic musical instrument of the embodiment shown in FIG. 1.

FIG. 2 shows the outer appearance of the panel switches of the electronic musical instrument of this embodiment. The panel switch unit 3 comprises style switches 31, accompaniment pattern selection switches 32, LEDs 33, registration selection switches 34, LEDs 35, a start/stop switch 36, and a fill-in switch 37. The panel switch unit 3 also comprises switches 38 such as tone color selection switches, various effect switches and the like for setting performance environment.

The style switches 31 include 10 switches for selecting an automatic accompaniment style (rock & roll, pops, and the like, which are classified by genres of music). The accompaniment pattern selection switches 32 include four switches for selecting an accompaniment pattern in a selected style. More specifically, the accompaniment pattern selection switches 32 includes a first verse pattern selection switch 32-1, a second verse pattern selection switch 32-1, a first chorus pattern selection switch 32-3, and a second chorus pattern selection switch 32-4.

The verse patterns are relatively basic accompaniment patterns, and the first and second verse patterns constitute one pattern group. The chorus patterns are accompaniment patterns used as variations, and the first and second chorus patterns constitute one pattern group. A user can select a desired pattern from the four accompaniment patterns (two verse patterns and two chorus patterns) according to each style. More specifically, when the user selects an accompaniment pattern, he or she selects one style using the style switches 31. When a style is selected, four accompaniment patterns according to the selected style are assigned to the accompaniment pattern selection switches 32-1 to 32-4. The user turns on one of the accompaniment pattern selection switches 32-1 to 32-4 to select a desired accompaniment pattern.

The four LEDs 33 arranged above the accompaniment pattern selection switches 32-1 to 32-4 are used for indicating the currently selected accompaniment pattern. When one of the accompaniment pattern selection switches 32-1 to 32-4 is turned on, an accompaniment pattern assigned to the ON switch is selected. At this time, the LED 33 above the ON switch is turned on, and the remaining three LEDs 33 are turned off.

The registration selection switches 34 include four switches for selecting a registration. More specifically, the registration selection switches 34 include a verse A selection switch 34-1, a verse B selection switch 34-2, a chorus A selection switch 34-3, and a chorus B selection switch 34-4. The user turns on one of these selection switches 34-1 to 34-4 to select a desired registration. The verse A, verse B, chorus A, and chorus B are names of registrations assigned to the switches 34-1 to 34-4.

The four registrations assigned to the four selection switches 34-1 to 34-4 are those according to the selected style at that time, in other words, four registrations suitable for the selected style. Therefore, the user can select a desired one of the four registrations suitable for the style, thereby determining a performance environment. Thus, generation of musically unnatural musical tones can be prevented upon selection of an improper registration, which does not match with the style.

Under any style, registrations assigned to the verse A and B selection switches 34-1 and 34-2 are those suitable for the accompaniment patterns assigned to the first and second verse pattern selection switches 32-1 and 32-2 at that time. Similarly, registrations assigned to the chorus A and B selection switches 34-3 and 34-4 are those suitable for the accompaniment patterns assigned to the first and second chorus pattern selection switches 32-3 and 32-4 at that time.

The four LEDs 35 arranged above the registration selection switches 34-1 to 34-4 are used for indicating the currently selected registration. The LEDs 35 also indicate whether the current mode is a normal mode (a mode other than a registration mode) or the registration mode. When all the four LEDs 35 are OFF, they indicate the normal mode. In the normal mode, a user can play in a performance environment according to the setting states of the tone color selection switches, the effect switches, and the like (switches 38 in FIG. 2). In this case, the user can finely set a desired performance environment by operating various switches.

When one of the registration selection switches 34-1 to 34-4 is turned on in the normal mode, the current mode is switched from the normal mode to the registration mode. At this time, the LED 35 above the selected registration selection switch 34 is turned on to indicate that a registration assigned to the selected switch is selected. When a registration is selected, a performance environment defined by the selected registration is set.

When one of the switches 34 other than the registration selection switch corresponding to the currently selected registration (i.e., the three switches, the LEDs 35 of which are OFF) is turned on in the registration mode, a registration assigned to the ON switch is newly selected. In this case, the registration mode is left unchanged. The performance environment is defined by the newly selected registration. Only the LED 35 above the newly selected registration selection switch is turned on, and the remaining LEDs are turned off.

When the registration selection switch 34 corresponding to the currently selected registration (i.e., the switch, the LED 35 of which is ON) is turned on in the registration mode, the current mode is switched from the registration mode to the normal mode. In this case, all the four LEDs 35 are turned off.

The start/stop switch 36 is a switch for instructing to start/stop an automatic accompaniment. When the start/stop switch 36 is turned on in a state wherein an automatic accompaniment is not executed, the automatic accompaniment is started using the accompaniment pattern selected at that time. When the start/stop switch 36 is turned on in a state wherein an automatic accompaniment is being executed, the automatic accompaniment is stopped.

The fill-in switch 37 is a switch for instructing to, e.g., insert a fill-in pattern in an automatic accompaniment. When the fill-in switch 37 is turned on in a state wherein an automatic accompaniment is being executed, the automatic accompaniment is executed using a fill-in pattern. Upon completion of the fill-in pattern, the automatic accompaniment is continued using another accompaniment pattern. More specifically, accompaniment patterns change as follows.

① first verse pattern→(fill-in switch 37 ON)→first fill-in pattern→first chorus pattern ② second verse pattern→(fill-in switch 37 ON)→second fill-in pattern→second chorus pattern ③ first chorus pattern→(fill-in switch 37 ON)→third fill-in pattern→first verse pattern ④ second chorus pattern→(fill-in switch 37 ON)→fourth fill-in pattern→second verse pattern Flags, registers, tables, and the like used in the electronic musical instrument of this embodiment will be explained below.

(a) REGFLAG: a registration flag. When this flag is "1", it indicates that the current mode is the registration mode; when it is "0", it indicates that the current mode is the normal mode.

(b) RUN: a run flag. When this flag is "1", it indicates that an automatic accompaniment is being executed; when it is "0", it indicates that an automatic accompaniment is being interrupted.

(c) CLK: a clock register for storing a value representing a timing in one bar. The content of this register is incremented by "1" every time a timer interrupt is generated by the timer 8, and is initialized to "0" at the end of one bar.

(d) PTNPOI: a pointer for addressing accompaniment pattern data.

(e) STYLE: a style register for storing a value indicating a currently selected style.

(f) ROOT: a root register for storing a value indicating the root of a chord detected from a performance in an accompaniment key area.

(g) TYPE: a type register for storing a value indicating the type (e.g., major, minor, or the like) of a chord detected from a performance in an accompaniment key area.

(h) REG: a registration register for storing various setting data for defining a current performance environment.

(i) TEMP: a temporary register for temporarily saving the content of the registration registers REG.

The flags and registers (a) to (i) are allocated on the RAM 7. These symbols represent the registers themselves, and also represent data stored in the corresponding registers. For example, "ROOT" represents the root register, and also represents root data stored in the root register.

In addition, the following data (j) and (k) are prepared in advance in the ROM 6.

Figure 3:
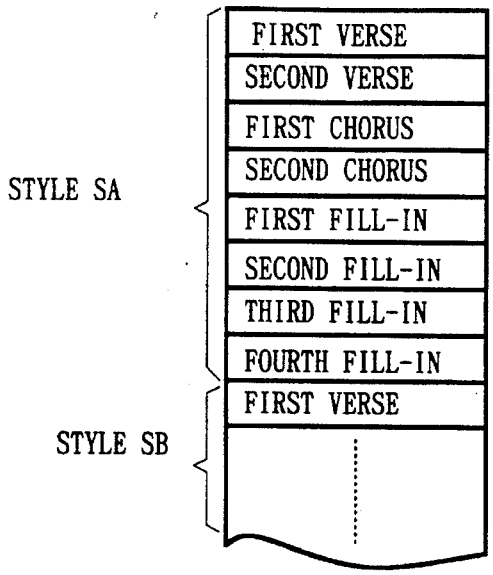
FIGS. 3(*a*) to 3(*c*) are views showing accompaniment pattern data, registration data, and transfer of the registration data.
Figure 3:
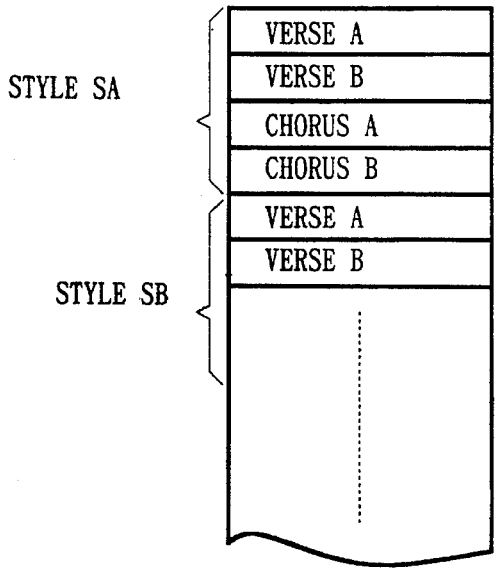
Figure 3:
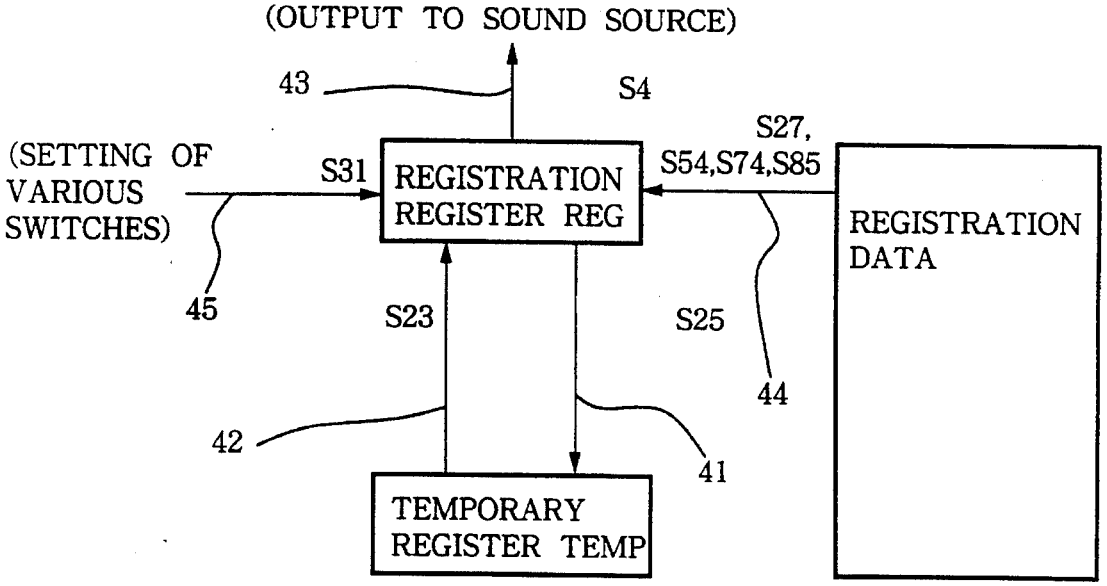

(j) Accompaniment pattern data: accompaniment patterns for each style. FIG. 3(*a*) shows the schematic architecture of the accompaniment pattern data. As shown in FIG. 3(*a*), accompaniment patterns corresponding to one style (e.g., style SA "rock & roll") include eight pattern data, i.e., first and second verse patterns, first and second chorus patterns, and first to fourth fill-in patterns. The first and second verse patterns and the first and second chorus patterns are respectively assigned to the four pattern selection switches 32-1 to 32-4, as described above. The first to fourth fill-in patterns are inserted when the above-mentioned fill-in switch 37 is turned on. As these eight pattern data, data suitable for each style are prepared in units of styles.

(k) Registration data: data representing registrations for each style. FIG. 3(*b*) shows the schematic architecture of the registration data. As shown in FIG. 3(*b*), four registration data, i.e., verse A, verse B, chorus A, and chorus B are prepared in correspondence with one style (e.g., style SA "rock & roll"). These registration data are respectively assigned to the four registration selection switches 34-1 to 34-4, as described above. As these registration data, those suitable for each style are prepared in units of styles. Note that registration data may sometimes represent each of verse A data, verse B data, and the like, i.e., a set of data for determining one performance environment, and may sometimes represent a group of a plurality of sets of data.

One registration data, e.g., verse A of style SA, has the following contents ① to ⑥.

① First tone color: information for specifying a tone color set as the first tone color.

② Second tone color: information for specifying a tone color set as the second tone color.

③ Tone color mode: information representing one of the following modes (i) to (iii).

(i) a mode for setting the tone color of musical tones generated by a performance on the keyboard 1 to be a tone color set as the first tone color (ii) a mode for setting the tone color of musical tones generated by a performance on the keyboard 1 to be tone colors set as the first and second tone colors (musical tones are generated in two tone colors)

(iii) a mode for dividing the keyboard 1 into first and second key areas, setting the tone color of musical tones generated by a performance in the first key area to be a tone color set as the first tone color, and setting the tone color of musical tones generated by a performance in the second key area to be a tone color set as the second tone color ④ Reverberation information: information associated with reverberation to be added to musical tones generated in a performance on the keyboard 1. This information includes data indicating whether reverberation is to be added (ON) or not to be added (OFF), a type of reverberation, a depth of reverberation, and the like.

⑤ Effect information: information associated witheffects such as flanger, distortion, and the like to be added to musical tones generated in a performance on the keyboard 1. This information includes data indicating whether an effect is to be added (ON) or not to be added (OFF), a type of effect, a depth of effect, and the like.

⑥ Accompaniment tone information: information associated with the tone color, tone volume, effect, and the like of accompaniment tones in an automatic accompaniment.

The operation of the electronic musical instrument of this embodiment will be described below with reference to the flow charts shown in FIGS. 4(*a*) to 8.

Figure 4:
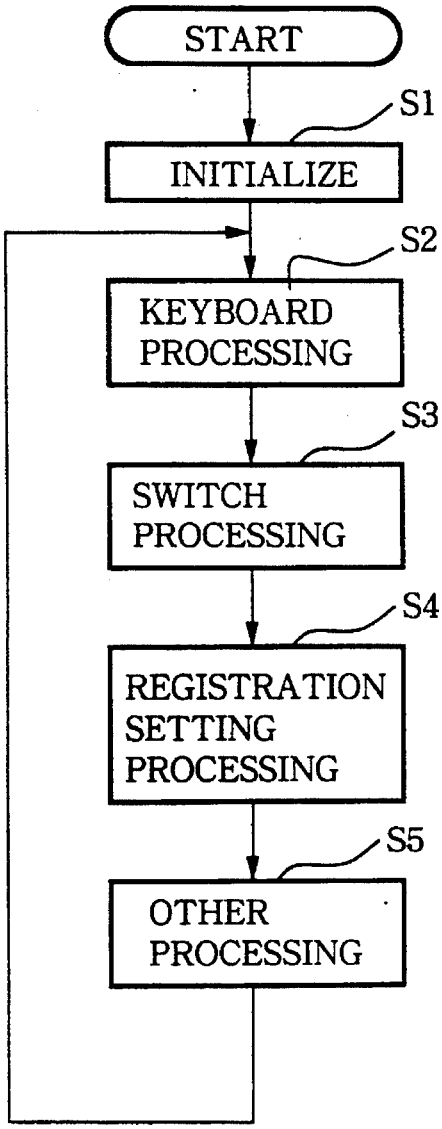
FIGS. 4(*a*) and 4(*b*) are flow charts respectively showing a main routine, and a keyboard processing routine.
Figure 4:
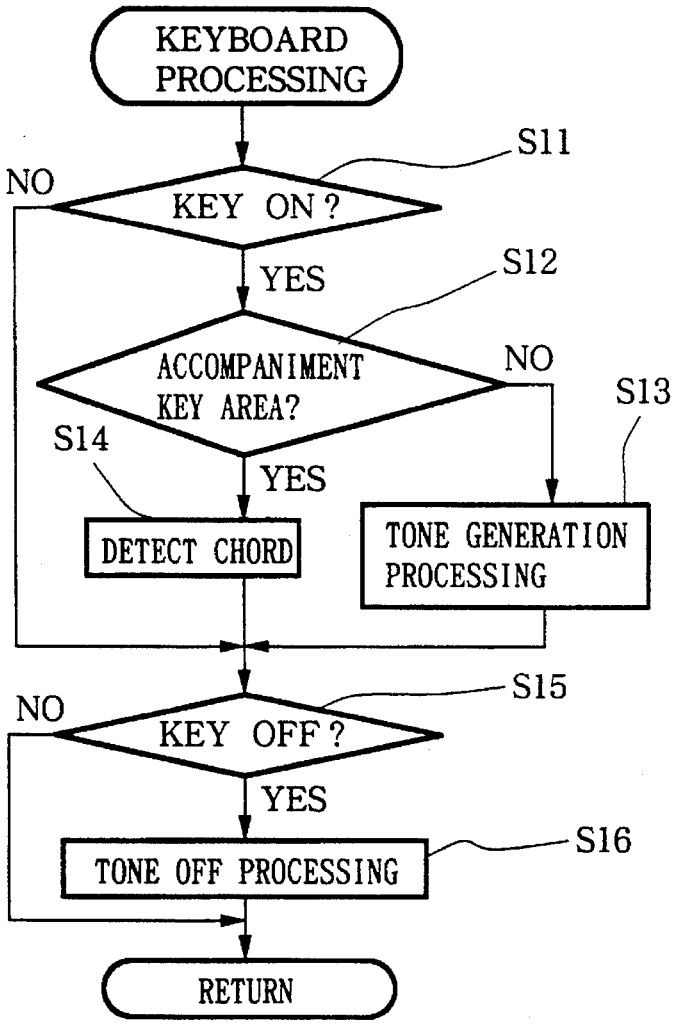

FIG. 4(*a*) shows the main routine of this electronic musical instrument. When the operation of this electronic musical instrument is started, the flags, registers, and the like are initialized in step S1. More specifically, "0" is set in the registration flag REGFLAG and the run flag RUN. In the registration register REG, various setting data for defining the current performance environment set by the tone color selection switches, various effect switches, and the like (switches 38 in FIG. 2) are set.

In step S2, keyboard processing is executed. In step S3, switch processing is executed. In step S4, registration setting processing is executed. In step S5, other processing is executed. Thereafter, the flow returns to step S2. Then, the processing operations in step S2 and subsequent steps are repeated.

Referring to FIG. 4(*b*), in the keyboard processing in step S2 in FIG. 4(*a*), it is checked in step S11 if a key ON event of one of the keys on the keyboard 1 is detected. If NO in step S11, the flow jumps to step S15. If YES in step S11, it is checked in step S12 if the key ON event is detected in an accompaniment key area. If NO in step S12, tone generation processing corresponding to the key ON event is executed in step S13, and thereafter, the flow advances to step S15. However, if YES in step S12, a chord is detected from a key ON state in step S14. More specifically, a chord root and type are detected, and are respectively set in the registers ROOT and TYPE. Thereafter, the flow advances to step S15.

It is checked in step S15 if a key OFF event of one of the keys on the keyboard 1 is detected. If YES in step S15, tone OFF processing associated with the key corresponding to the key OFF event is executed in step S16, and thereafter, the flow returns to the main routine. If NO in step S15, the flow directly returns to the main routine.

Figure 5:
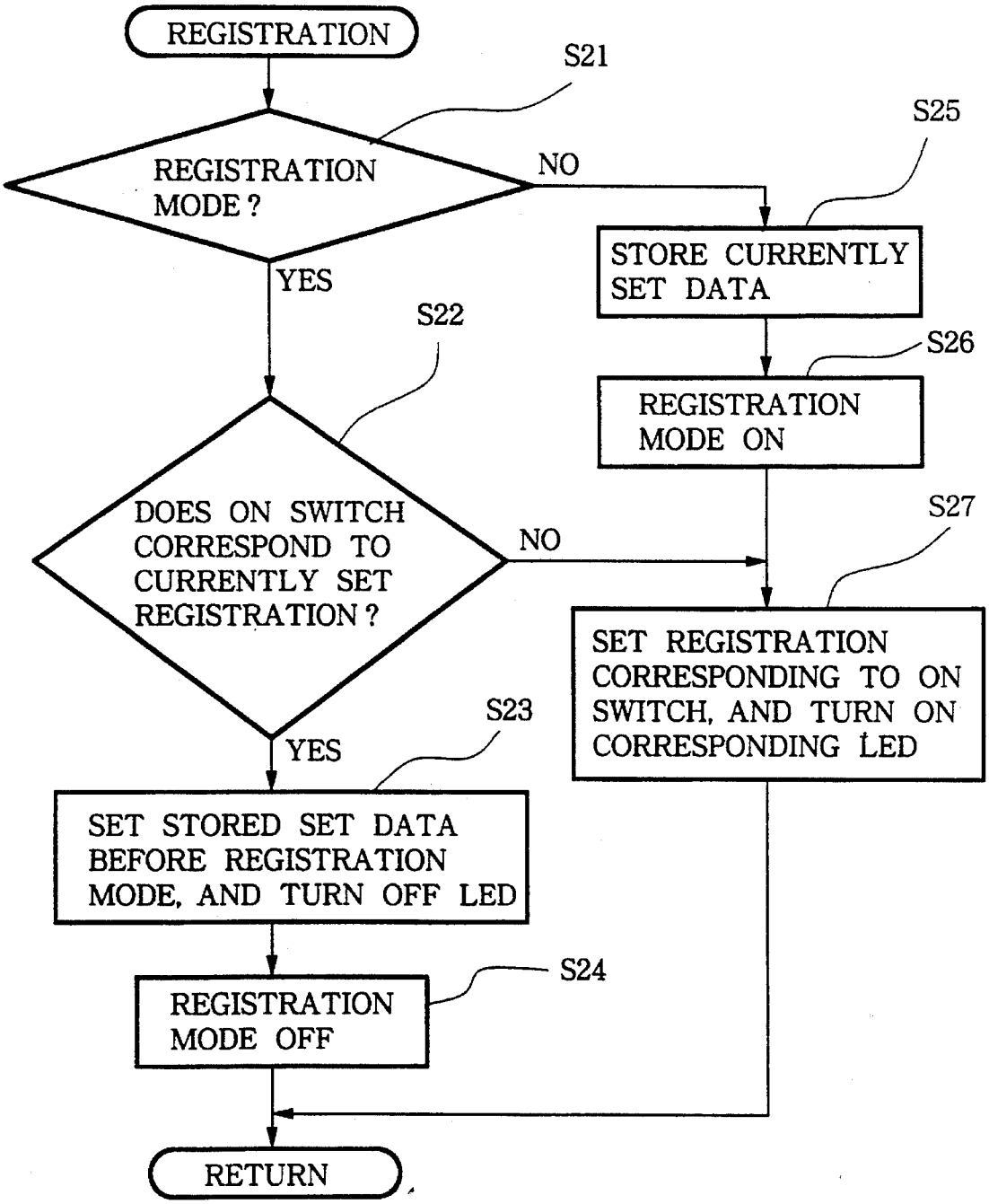
FIG. 5 is a flow chart showing a registration processing routine.
Figure 6:
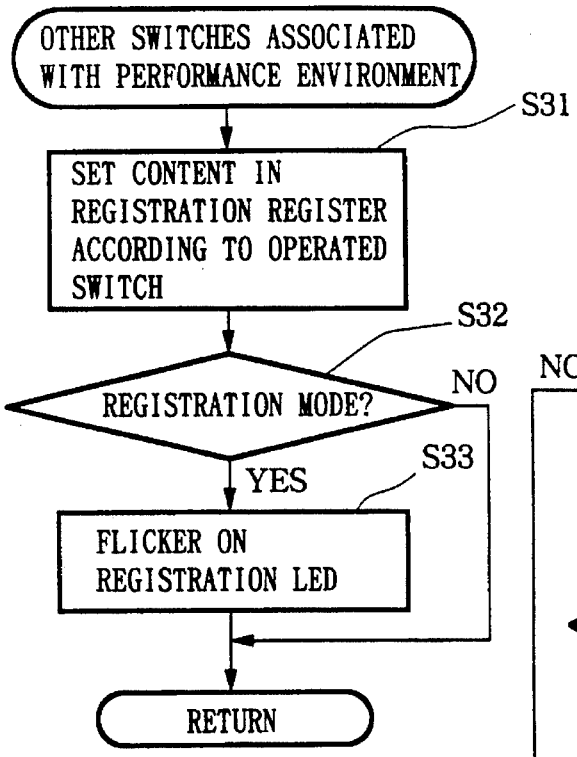
FIGS. 6(*a*) to 6(*c*) are flow charts respectively showing a performance environment setting switch processing routine, a style setting processing routine, and a pattern setting processing routine.
Figure 6:
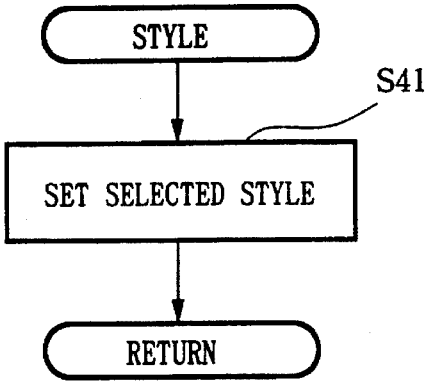
Figure 6:
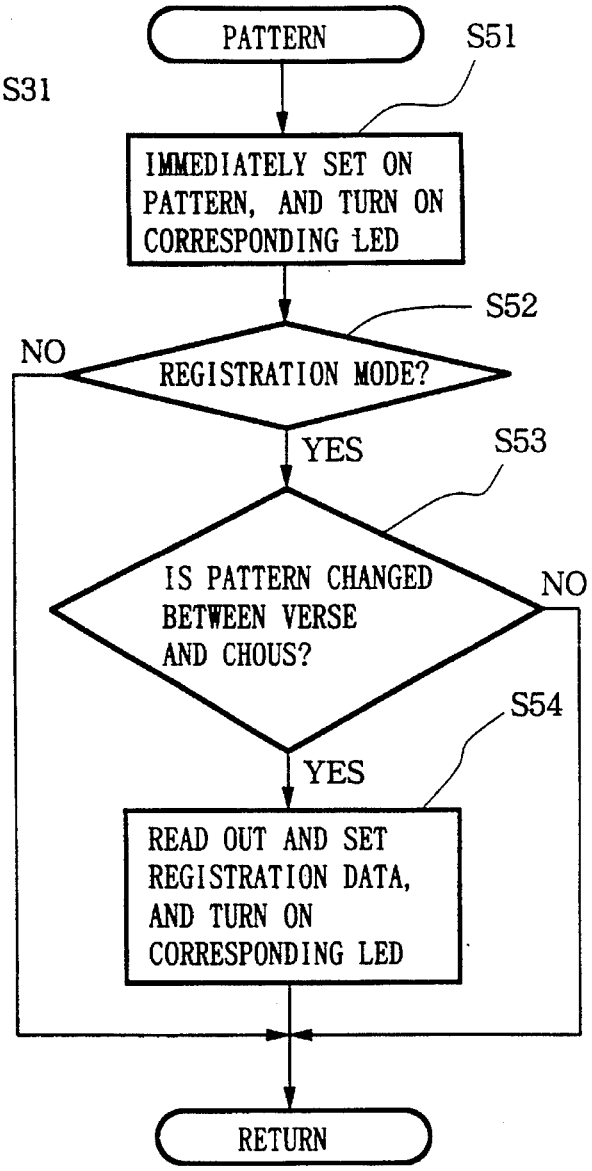

In the switch processing in step S3 in FIG. 4(*a*), an operation of the switch on the panel is detected, and processing according to the operation is executed. FIGS. 5, 6(*a*), 6(*b*), 6(*c*), 7(*a*), and 7(*b*) are flow charts showing processing operations executed in the switch processing (step S3) when predetermined switches are operated.

FIG. 5 shows a registration processing routine executed when the registration selection switch 34 shown in FIG. 2 is turned on. In the registration processing routine, it is checked in step S21 with reference to the flag REGFLAG if the current mode is the registration mode. If NO in step S21, data currently set in the registration register REG (data representing a performance environment set by various switches on the panel) is saved in the temporary register TEMP in step S25, as indicated by reference numeral 41 in FIG. 3(*c*), and "1" is set in the flag REGFLAG to set the registration mode in step S26.

In step S27, a registration corresponding to the ON registration selection switch 34 is set, and the corresponding LED 35 is turned on. More specifically, in this processing, one registration is read out from the registration data shown in FIG. 3(*b*) according to the currently selected style STYLE and the ON registration selection switch 34 (one of verse A, verse B, chorus A, and chorus B), and is set in the registration register REG, as indicated by reference numeral 44 in FIG. 3(*c*). After step S27, the flow returns to the main routine.

If it is determined in step S21 that the current mode is the registration mode, it is checked in step S22 if the ON registration selection switch 34 (one of the switches 34-1 to 34-4) corresponds to the currently selected registration. In other words, it is checked if the registration selection switch 34 corresponding to the ON LED 35 is turned on, or another registration selection switch 34 is turned on.

If it is determined in step S22 that the 0N registration selection switch 34 corresponds to the currently selected registration, the data (data representing the performance environment before the registration mode is set) saved in the temporary register TEMP is set in the registration register REG, as indicated by reference numeral 42 in FIG. 3(*c*), so as to restore the normal mode from the registration mode, and the LED 35 is turned off in step S23. In step S24, the flag REGFLAG is reset to "0", and the flow returns to the main routine.

When the content of the registration register REG is changed by the above-mentioned registration processing or other processing, or is initialized in step S1 in FIG. 4(*a*), the initialized or changed content is detected in the registration setting processing in step S4 in FIG. 4(*a*). As indicated by reference numeral 43 in FIG. 3(*c*), initialized or changed data is supplied to the sound source circuit 10. Thus, a performance environment based on data set in the registration register REG is actually set.

FIG. 6(*a*) shows a processing routine executed when various switches such as the tone color selection switches, the effect switches, and the like (switches 38 in FIG. 2) for setting a performance environment are operated. In step S31, an operation content is set in the registration register REG according to an operated switch (reference numeral 45 in FIG. 3(*c*)). Then, it is checked in step S32 with reference to the registration flag REGFLAG if the current mode is the registration mode.

If YES in step S32, since this means that a user wants to intentionally change the readout registration, the currently ON LED 35 (representing the currently selected registration) is caused to flicker in step S33 so as to indicate it, and the flow returns to the main routine. If NO in step S32, the flow directly returns to the main routine.

FIG. 6(*b*) shows a style setting processing routine executed when the style switch 31 shown in FIG. 2 is turned on. In the style setting processing routine, a value representing the selected style is set in the register STYLE in step S41, and thereafter, the flow returns to the main routine.

FIG. 6(*c*) shows a pattern setting processing routine executed when the pattern selection switch 32 shown in FIG. 2 is turned on. In the pattern setting processing routine, an accompaniment pattern corresponding to the ON pattern selection switch 32 is immediately set in step S51, and the corresponding LED 33 is turned on.

More specifically, the accompaniment pattern setting processing is as follows. That is, one accompaniment pattern is specified from the accompaniment pattern data shown in FIG. 3(*a*) according to the currently selected style STYLE and the ON pattern selection switch 32 (one of first verse, second verse, first chorus, and second chorus), and the address of the specified accompaniment pattern is set in the pointer PTNPOI. When an automatic accompaniment is not executed, the start address of the accompaniment pattern is set in the pointer PTNPOI. When an automatic accompaniment is being executed, since the current timing is not always the end of a bar, pattern data is looked up from the start address of the accompaniment pattern to search pattern data to be processed first after the current timing CLK, and the address of the searched pattern data is set in the pointer PTNPOI.

It is then checked in step S52 if the current mode is the registration mode. If NO in step S52, the flow returns to the main routine. However, if YES in step S52, it is checked in step S53 if the accompaniment pattern is changed between a verse pattern and a chorus pattern. If NO in step S53, the flow returns to the main routine. However, if YES in step S53, registration data is read out to the register REG according to the change in accompaniment pattern (reference numeral 44 in FIG. 3(*c*)), and the corresponding LED 35 is turned on in step S54. Thereafter, the flow returns to the main routine.

The processing in steps S53 and S54 is processing for switching a registration in correspondence with a change in accompaniment pattern. More specifically, when an accompaniment pattern is changed from the first or second verse pattern to the first or second chorus pattern, if the original registration is verse A or B, the registration is changed to chorus A or B. On the other hand, when an accompaniment pattern is changed from the first or second chorus pattern to the first or second verse pattern, if the original registration is chorus A or B, the registration is changed to verse A or B.

Since a registration is switched as well in correspondence with the changed accompaniment pattern, when the accompaniment pattern is switched, various setting data associated with performance tones (by a manual performance of a user) on the keyboard are also changed, and a dynamic performance with a full range of changes can be realized by an easy operation. When an accompaniment pattern is switched between the verse patterns or between the chorus patterns, the degree of variation of the accompaniment pattern (the degree of change in atmosphere of a music upon a change in accompaniment pattern) is relatively small. In this case, a registration is left unchanged, and the performance environment is only slightly changed. On the other hand, when an accompaniment pattern is switched between the verse and chorus patterns, since the degree of variation of the accompaniment pattern is large, the registration is also changed to realize a dynamic change.

Figure 7:
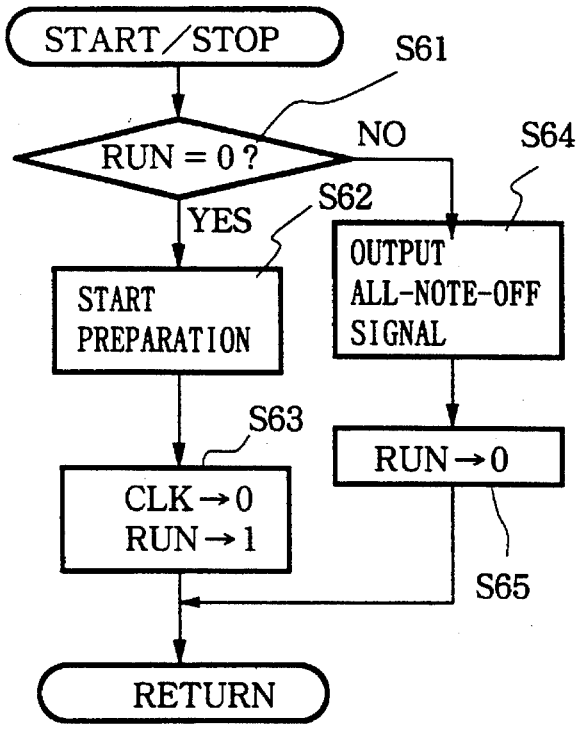
FIGS. 7(*a*) and 7(*b*) are flow charts respectively showing a start/stop switch processing routine, and a fill-in switch processing routine.
Figure 7:
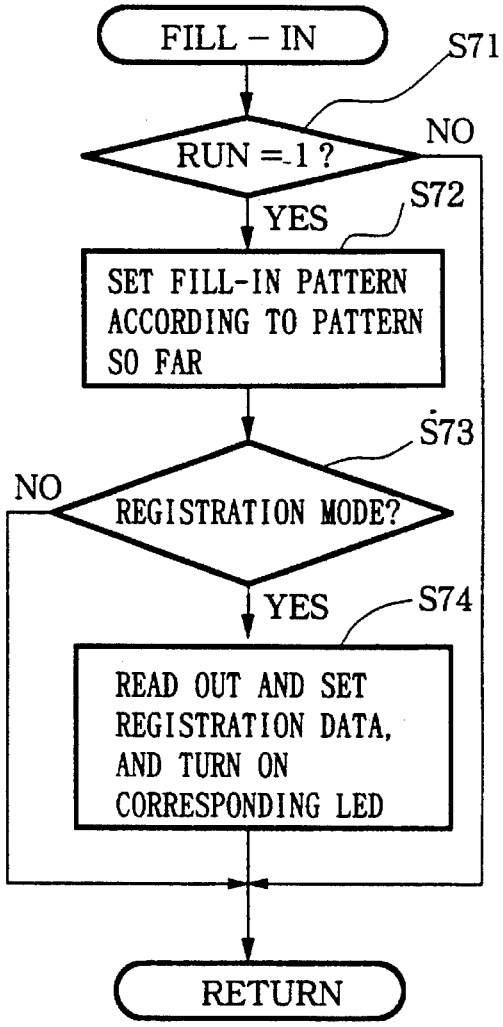

FIG. 7(*a*) shows a start/stop switch processing routine executed when the start/stop switch 36 shown in FIG. 2 is turned on. In the start/stop switch processing routine, it is checked in step S61 if the run flag RUN is "0". If YES in step S61, since this means that the start/stop switch 36 is turned on in a state wherein an automatic accompaniment is being interrupted, start preparation for the automatic accompaniment is performed in step S62. In step S63, an initial value "0" is set in the clock CLK, and "1" is set in the run flag RUN. Thereafter, the flow returns to the main routine. Thus, execution of the automatic accompaniment is started.

In the start preparation in step S62, processing for searching the currently selected accompaniment pattern of the currently selected style STYLE from the accompaniment pattern data shown in FIG. 3(*a*), and setting its start address in the pointer PTNPOI, and the like are executed.

If it is determined in step S61 that the run flag RUN is not "0", since this means that the start/stop switch 36 is turned on in a state wherein an automatic accompaniment is being executed, an all-note-off signal for muting all the currently generated automatic accompaniment tones is supplied to the sound source circuit 10 in step S64, and the run flag RUN is reset to "0" in step S65. Thereafter, the flow returns to the main routine. In this manner, execution of the automatic accompaniment is stopped.

FIG. 7(*b*) shows a fill-in switch processing routine executed when the fill-in switch 37 shown in FIG. 2 is turned on. In the fill-in switch processing routine, it is checked in step S71 if the run flag RUN is "1". If NO in step S71, since an automatic accompaniment is being interrupted, the flow returns to the main routine. However, if YES in step S71, a fill-in pattern is set according to the accompaniment pattern so far in step S72. More specifically, if the accompaniment pattern so far is the first verse pattern, the pointer PTNPOI is moved to the first fill-in pattern; if it is the second verse pattern, the pointer is moved to the second fill-in pattern; if it is the first chorus pattern, the pointer is moved to the third fill-in pattern; and if it is the second chorus pattern, the pointer is moved to the fourth fill-in pattern.

These fill-in patterns are set in the accompaniment pattern data in units of styles, as shown in FIG. 3(*a*). In particular, when the automatic accompaniment is being executed, since the current timing is not always the end of a bar, pattern data is looked up from the start address of the fill-in pattern to search pattern data to be processed first after the current timing CLK, and the address of the searched pattern data is set in the pointer PTNPOI in step S72.

It is then checked in step S73 with reference to the registration flag REGFLAG if the current mode is the registration mode. If NO in step S73, the flow returns to the main routine. However, if YES in step S73, registration data is read out to the register REG according to the change in accompaniment pattern (reference numeral 44 in FIG. 3(*c*)), and the corresponding LED 35 is turned on in step S74. Thereafter, the flow returns to the main routine. When the fill-in pattern is inserted, since the accompaniment pattern is changed between the verse and chorus patterns, as has been described above with reference to FIG. 2, a registration is switched in step S74 in the same manner as in step S54.

Figure 8:
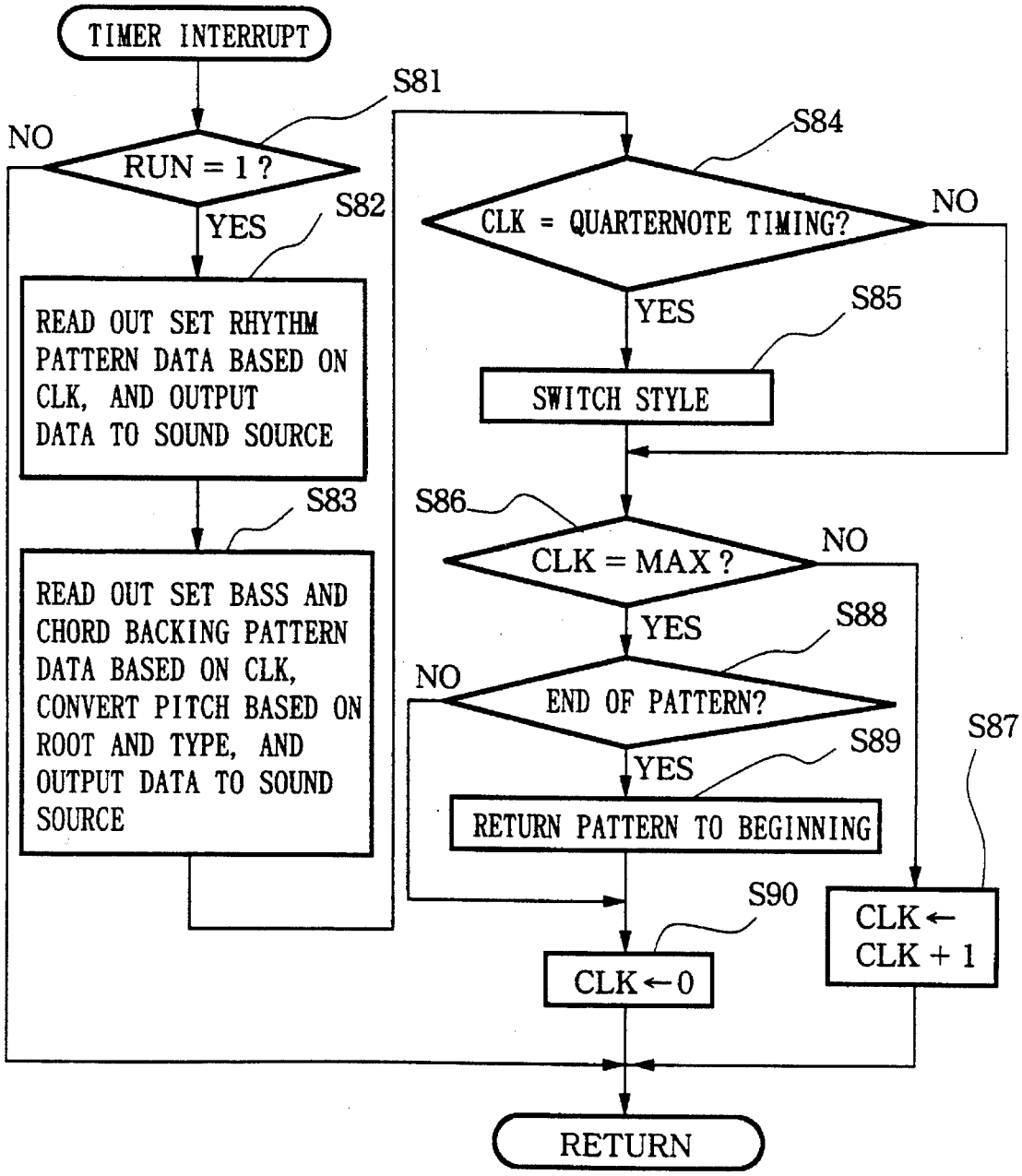
FIG. 8 is a flow chart showing a timer interrupt processing routine.

Timer interrupt processing will be described below with reference to FIG. 8. The timer interrupt processing is executed every time the timer 8 generates an interrupt signal at a predetermined time interval. For example, the timer 8 is adjusted to generate 24 interrupt signals per beat (quarternote).

In the timer interrupt processing, it is checked in step S81 if the run flag RUN is "1". If NO in step S81, since the automatic accompaniment is being interrupted, the flow returns to the main routine. However, if YES in step S81, rhythm pattern data of the pattern data pointed by the pointer PTNPOI is read out on the basis of the clock value CLK representing the current timing, and if a tone generation timing is reached, the pattern data is supplied to the sound source circuit 10 in step S82. Thus, a rhythm tone in an automatic accompaniment is produced.

In step S83, bass and chord backing pattern data of the pattern data pointed by the pointer PTNPOI are read out on the basis of the clock value CLK. If a tone generation timing is reached, the tone pitch is converted according to the root ROOT and the type TYPE, and is supplied to the sound source circuit 10. Thus, bass and chord backing tones in an automatic accompaniment are produced.

It is then checked in step S84 if the clock value CLK indicates a timing at the end of one beat (i.e., the end of a quarternote). If YES in step S84, style switching processing is executed in step S85, and the flow then advances to step S86. In the style switching processing, an accompaniment pattern and a registration are switched when the style switch 31 is operated to select a new style during execution of the automatic accompaniment. If the style switch 31 is not operated, no processing is executed. If it is determined in step S84 that the current timing is not a timing at the end of one beat, the flow advances to step S86.

It is checked in step S86 if the clock CLK is equal to a maximum value MAX. The maximum value MAX is a maximum possible value of the clock CLK, which is determined in units of styles. For example, if 24 interrupt signals are generated per beat of a quarternote, and if four-four time is set, $0 \leqq CLK \leqq 24 \times 4 - 1$ in one bar, and MAX=95. If three-four time is set, $0 \leqq CLK \leqq 24 \times 3 - 1$ in one bar, and MAX=71.

If it is determined in step S86 that the clock CLK is not equal to the maximum value MAX, the clock CLK is incremented by "1" in step S87, and the flow returns to the main routine. However, if it is determined in step S86 that the clock CLK is equal to the maximum value MAX, the pointer PTNPOI is checked in step S88 to determine if the accompaniment pattern is ended. If YES in step S88, the pointer PTNPOI is set to indicate the beginning of the accompaniment pattern in step S89. At this time, if the pattern so far is a fill-in pattern, the pattern is changed between the verse and chorus patterns, and the pointer PTNPOI is set. Otherwise, the pointer PTNPOI can be returned to the beginning of the same pattern. When the pattern is changed, only the LED 33 corresponding to the changed pattern is turned on.

After step S89, or it is determined in step S88 if the accompaniment pattern is not ended, the clock CLK is cleared to "0" in step S90, and the flow returns to the main routine.

In the above embodiment, an accompaniment pattern including rhythm, bass, and chord backing tones is used. Alternatively, an accompaniment pattern including rhythm, bass, or chord backing tones alone may be used. A combination of data (e.g., the tone color, tone volume, and the like) in the registration data is not particularly limited. For example, in the above embodiment, the registration data includes information for defining the tone color of automatic accompaniment tones. However, such information may be excluded, and only information for defining a performance environment of manual performance tones by a user may be set as registration data.

As described above, according to the present invention, a plurality of registrations are prepared in units of accompaniment patterns. When an accompaniment pattern is selected and designated, a registration can be selected from the plurality of registrations corresponding to the selected accompaniment pattern. For this reason, as long as a plurality of registrations suitable for each accompaniment pattern are prepared in units of accompaniment patterns, when a user selects any registration therefrom, the accompaniment pattern and the registration can always be harmonized with each other.

A plurality of accompaniment patterns (e.g., basic patterns and their variation patterns) are prepared in units of styles, and when an accompaniment pattern is changed, the registration is changed accordingly. Thus, the tone color of manual performance tones is changed upon a change in accompaniment pattern, and a performance environment can be largely changed by an easy operation. Therefore, a dynamic performance with a full range of changes can be realized. In addition, the accompaniment pattern and the registration can always be harmonized with each other.

When an accompaniment pattern is changed between different pattern groups (e.g., the verse and chorus patterns in the above embodiment) to have a large degree of variation of the accompaniment pattern, the registration is simultaneously changed, thus realizing a dynamic change in performance environment. On the other hand, when an accompaniment pattern is changed in a single pattern group to have a relatively small degree of variation, since the registration is left unchanged, the performance environment is slightly changed. Therefore, precise control ranging from a slight change to a dynamic change can be realized by an easy operation.

What is claimed is

1. An electronic musical instrument comprising:

pattern storage means for storing a plurality of accompaniment pattern data;

registration storage means for storing a plurality of registration data, said plurality of registration data being divided into a plurality of groups, each groups consisting of a plurality of registration data and the plurality of groups corresponding to the plurality of accompaniment pattern data;

pattern designation means for selecting and designating one accompaniment pattern data from the plurality of accompaniment pattern data;

registration designation means for selecting and designating one registration data from the plurality of registration data of the group which corresponds to the one accompaniment pattern data selected and designated by said pattern designation means;

automatic accompaniment means for performing an automatic accompaniment on the basis of the one accompaniment pattern data selected and designated by said pattern designation means; and performance environment setting means for setting a performance environment on the basis of the one registration data selected and designated by said registration designation means.

2. An electronic musical instrument according to claim 1, wherein said registration data is stored as factory preset data.

3. An electronic musical instrument according to claim 1, further comprising:

memory means for, when said registration designation means selects and designates registration data, saving a prior performance environment that is currently being used before the performance environment based on the registration data is set, and wherein said registration designation means includes means for canceling the selected and designated registration data, and when the registration data is canceled by the means for canceling, the prior performance environment saved in said memory means is reset.

4. An electronic musical instrument comprising:

pattern storage means for storing a plurality of accompaniment patterns for each of a plurality of accompaniment styles;

registration storage means for storing a plurality of registration data for each of the accompaniment styles;

style designation means for selecting and designating one accompaniment style from the plurality of accompaniment styles;

pattern designation means for selecting and designating one accompaniment pattern data from the plurality of accompaniment pattern data corresponding to the accompaniment style selected and designated by said style designation means;

registration designation means for selecting and designating one registration data from the plurality of registration data corresponding to the accompaniment style selected and designated by said style designation means;

automatic accompaniment means for performing an automatic accompaniment on the basis of the accompaniment pattern data selected and designated by said pattern designation means; and performance environment setting means for setting a performance environment on the basis of the registration data selected and designated by said registration designation means.

5. An electronic musical instrument according to claim 4, further comprising:

registration change control means for correspondingly changing the registration data between the registrations according to the accompaniment style when the accompaniment pattern data is changed in the same accompaniment style by said pattern designation means.

6. An electronic musical instrument according to claim 4, wherein said registration designation means includes a plurality of registration select switches, and when the accompaniment style is selected, the plurality of registration data corresponding to the selected accompaniment style are assigned to the registration select switches.

7. An electronic musical instrument according to claim 4, wherein said pattern designation means includes a plurality of pattern selected switches, and when the accompaniment style is selected, the plurality of accompaniment pattern data corresponding to the selected accompaniment style are assigned to the pattern select switches.

8. An electronic musical instrument according to claim 5, wherein the plurality of accompaniment patterns for each accompaniment style are grouped into a first pattern group consisting of a plurality of basic accompaniment patterns, and a second pattern group consisting of a plurality of variation patterns, and when the accompaniment pattern data is changed between different pattern groups by said pattern designation means, said registration change control means changes the registration data in correspondence with the changed accompaniment pattern data, and when the accompaniment pattern data is not charged between the pattern groups, said registration change control means does not change the registration data.

9. An electronic instrument according to claim 4, further comprising:

a fill-in switch; and fill-in pattern storage means for storing a plurality of fill-in patterns, such that when said fill-in switch is turned on, the selected accompaniment pattern is changed to the fill-in pattern corresponding to the selected accompaniment pattern, and thereafter, when the corresponding fill-in pattern is completed, the corresponding fill-in pattern is changed to another accompaniment pattern.

10. An electronic musical instrument comprising:

registration storage means for storing registration data representing a plurality of parameters which decide a performance environment;

an environment setting operative element for manually designating each of the plurality of parameters which decide a performance environment;

parameter storage means for storing the plurality of parameters so as to realize a desired performance environment based on the stored plurality of parameters;

mode selection means for selecting a first mode of a second mode;

performance environment setting means for, when the current mode is the first mode, controlling said parameter storage means to store the plurality of parameters designated by said environment setting operative element, and for when the current mode is the second mode, controlling said parameter storage means to storage the registration data stored by said registration storage means; and performance environment control means for, when the current mode is changed from the first mode to the second mode by said mode selection means, saving the plurality of parameters stored by the parameter storage means into a temporary memory, and for, when the current mode is changed from the second mode to the first mode by said mode selection means, restoring the saved plurality of parameters from the temporary memory to the parameter storage means.

11. An electronic musical instrument according to claim 10, wherein said registration storage means stores a plurality of registration data, and said mode selection means includes registration designation means for selecting one registration data from the plurality of registration data and, when a registration data is selected in the first mode, change the current mode from the first mode to the second mode.

12. An electronic musical instrument comprising:

parameter storage means for storing a set of parameters defining a current performance environment;

registration storage means for storing registration data consisting of a set of parameters for defining a performance environment;

operation means for setting and changing the parameters stored in said parameter storage means according to user operation;

designation means for designating a registration mode to be set and released;

control means for, when setting the registration mode as designated by said designation means, saving the set of parameters stored in said parameter storage means into a temporary memory and storing the set of parameters of said registration data stored in said registration storage means into said parameter storage means, and for, when releasing the registration mode as designated by said designation means, restoring the saved set of parameters from the temporary memory to said parameter storage means.

13. A method of setting a musical environment for an electronic musical instrument, the method comprising the steps of:

selecting a musical style pattern from a plurality of stored musical style patterns;

selecting a registration data set from a plurality of registration data sets that are divided into a plurality of registration data groups, the registration data groups corresponding to the plurality of stored musical style patterns and the selected registration data set being selected from the group corresponding to the selected musical style pattern;

selecting an accompaniment pattern from a plurality of accompaniment patterns that are divided into a plurality of accompaniment pattern groups, the accompaniment pattern groups corresponding to the plurality of stored musical style patterns and the selected accompaniment pattern being selected from the group corresponding to the selected musical style pattern;

automatically performing the selected accompaniment pattern; and setting a musical environment on the basis of the selected registration data.

14. A method of playing music on an electronic musical instrument, the method comprising the steps of:

selecting a plurality of performance parameters;

selecting a first mode that stores the selected performance parameters in a parameter storage to allow the playing of the music in accordance with the selected performance parameters;

selecting a registration data set;

selecting a second mode that temporarily stores the selected performance parameters in a temporary memory and stores the selected registration data set in the parameter storage to allow the playing of the music in accordance with the selected registration data set; and returning to the first mode to return the stored performance parameters from the temporary memory to the parameter storage to allow the playing of the music in accordance with the returned performance parameters.

* * * * *